US005235130A

United States Patent [19]

Demoto et al.

[11] Patent Number: 5,235,130

[45] Date of Patent: Aug. 10, 1993

[54] DEVELOPER CARTRIDGE

[75] Inventors: Miki Demoto; Katsuzo Uchida; Keiji Kato, all of Nara; Naoyuki Yamane, Yamatokoriyama; Yasuo Imai, Nara; Hisashi Kunihiro, Tenri, all of Japan

[73] Assignee: Sharp Kabushiki Kaisha, Osaka, Japan

[21] Appl. No.: 948,138

[22] Filed: Sep. 18, 1992

[30] Foreign Application Priority Data

Sep. 20, 1991 [JP] Japan ..... 3-241573

[51] Int. Cl.[5] ..... G03G 15/08

[52] U.S. Cl. ..... 118/653; 355/245; 222/DIG. 1

[58] Field of Search ..... 355/245, 251-253, 355/255, 259; 118/653, 657, 658; 222/DIG. 1, 541, 327

[56] References Cited

U.S. PATENT DOCUMENTS 5,134,441 7/1992 Nagata et al. ..... 355/245

FOREIGN PATENT DOCUMENTS 1-250975 10/1989 Japan ..... 355/245

OTHER PUBLICATIONS

Abstract of Japanese Patent Document 3-221981, Document published Sep. 30, 1991.

*Primary Examiner*—R. L. Moses

*Attorney, Agent, or Firm*—David G. Conlin; George W. Neuner

[57] ABSTRACT

A developer cartridge is provided to prevent toner from overflowing a toner hopper into a development tank, and to prevent a toner supply roller from being deformed by heavy pressure. In order to achieve the object, the developer cartridge is provided with a seal member (8) in the toner hopper (2). The seal member has one end blocking a toner supply port (9) and the other end secured to a rotary shaft (*7a*) of an agitating member (7). The seal member is rolled up by rotating the agitating member when using the cartridge for the first time.

1 Claim, 2 Drawing Sheets

DEVELOPER CARTRIDGE

BACKGROUND OF THE INVENTION

1. Field of the Invention

The present invention relates to a developer cartridge integrally provided with a toner hopper containing toner and a development tank to which the toner in the toner hopper can be supplied according to toner density in the tank. In particular, the invention relates to a sealing means of a toner supply port used for supplying the toner from the toner hopper to the development tank, at a time when shipping the developer cartridge.

2. Description of the Prior Art

In an image-forming machine for performing an image formation by using toner, the image-forming machine is shipped with a development apparatus containing developer. In recent years, a typical development apparatus (developer cartridge) has been integrally provided with a toner hopper and a development tank used for processing. Further, the development tank contains two-component developer made of the toner and carrier, and the toner hopper includes the toner. The toner hopper is mounted above the development tank, and a toner supply port is provided between the toner hopper and the development tank. A toner supply roller having a surface made of an elastic material such as sponge is mounted on the side of the toner hopper with respect to the toner supply port. The toner supply roller is operated to rotate so that the toner in the toner hopper can be supplied through the toner supply port to drop in the development tank. When shipping the developer cartridge, the development tank and the toner hopper contain the developer and the toner as described hereinbefore, respectively. In addition, toner density in the development tank is adjusted to a predetermined density.

However, if shipping the developer cartridge in the condition as set forth above, the toner hopper may spill the toner into the development tank due to, for example, vibrations. As a result, the toner density in the development becomes high. Further, the toner supply roller has the surface formed of the elastic material such as sponge, and has a lower surface side contacting the toner supply port with pressure. Accordingly, the lower surface side of the toner supply roller may be deformed along an opening of the toner supply port if stored in the above condition for a long period. As a result, there is a problem of causing excessive high starting torque of the toner supply roller.

In order to avoid these problems, some of the conventional developer cartridges are shipped without containing the developer (the toner and the carrier). However, the developer should be supplied by a service man or a user himself when installing the development apparatus. As a result, there is another drawback that a complicated operation is required for supplying the toner during the installation operation.

SUMMARY OF THE INVENTION

It is an object of the present invention to provide a developer cartridge which can prevent toner hopper from spilling a toner into a development tank, and prevent a toner supply roller contacted under pressure from being deformed when, for example, shipping or storing the developer cartridge.

In order to accomplish the object set forth above, a developer cartridge of the present invention is integrally provided with a toner hopper and a development tank, and has a toner supply roller disposed between the toner hopper and the development tank to supply toner from the toner hopper to the development tank, and the toner hopper including a rotatable agitating member. The developer cartridge is provided with a seal member including one end held between a toner supply port and the toner supply roller to seal the toner supply port passing from the toner hopper to the development tank, and the other end secured to the agitating member. Furthermore, the seal member is wound around the agitating member by rotation of the agitating member.

According to the present invention, the toner hopper never spills the toner into the development tank since the toner supply port is sealed by one end of the seal member which is held between the toner supply roller and the toner supply port. In addition, the toner supply roller is never deformed along the toner supply port because the toner supply port is blocked. Thus, if the agitating member is rotated when using the cartridge for the first time, the seal member is automatically wound around the agitating member. Accordingly, the toner supply port can be opened to supply the toner from the toner hopper into the development tank.

DESCRIPTION OF THE PREFERRED EMBODIMENTS

The present invention will be specifically described hereinafter with reference to the drawings.

Figure 1:
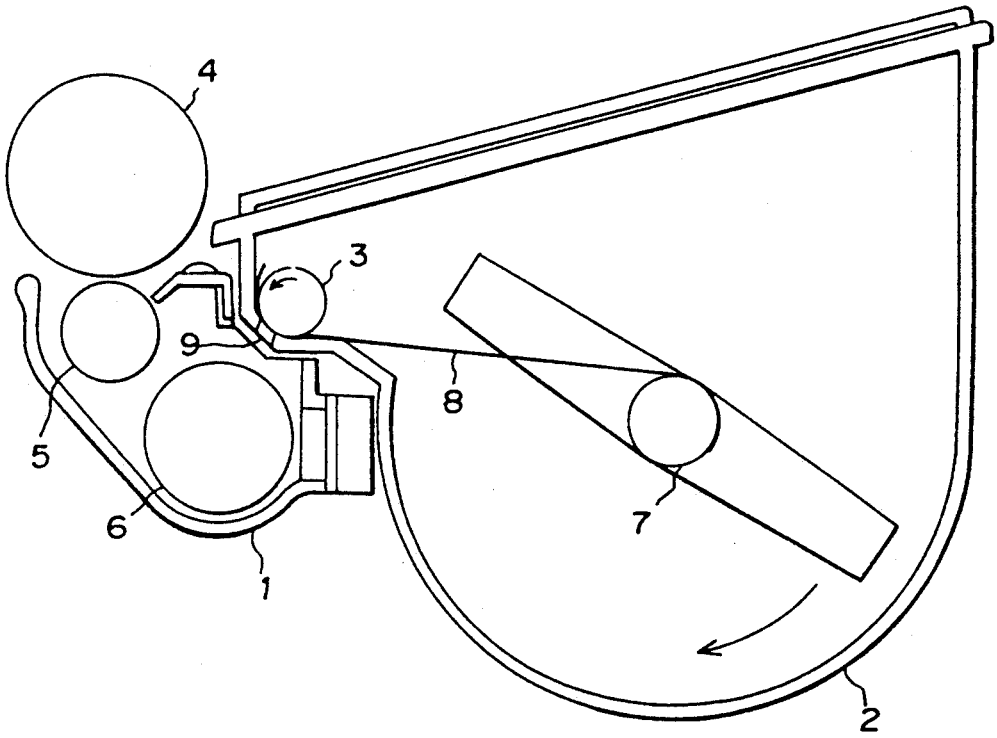
FIG. 1 is a view showing a schematic construction of a developer cartridge.

FIG. 1 shows a construction of a developer cartridge of an embodiment of the present invention, and the developer cartridge is in the shipping condition. The developer cartridge comprises a development tank 1 and a toner hopper 2. The development tank 1 contains a developer made of toner and carrier, and is rotatably provided with an agitating roller 6 and a magnet roller 5 in the development tank 1. A photosensitive body 4 having photo-conductivity is arranged opposite to the magnet roller 5. When shipping the developer cartridge (image-forming machine), density of the developer (toner density) in the development tank 1 is set to the optimal condition for processing.

Figure 2:
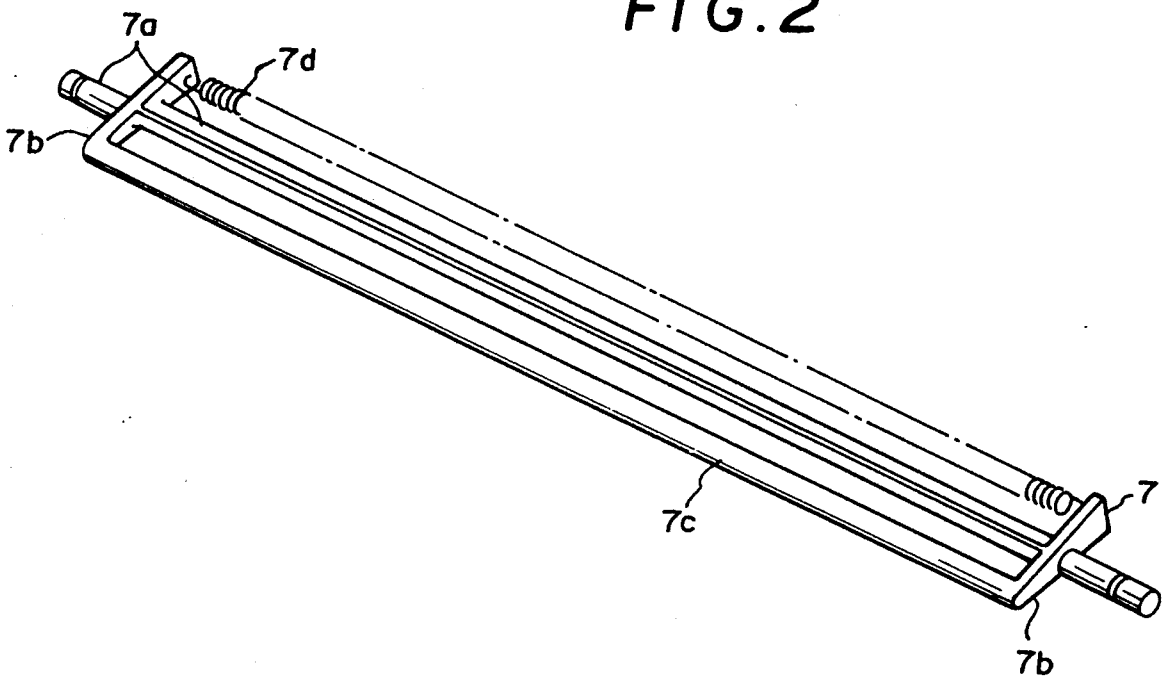
FIG. 2 is a view showing an agitating member in a toner hopper.

The toner hopper 2 contains the toner, and includes an agitating member 7 and a toner supply roller 3. The agitating member 7 is provided with a supporting portion **7*b* at right angle to a rotary shaft 7*a* at forward and back ends of the rotary shaft 7*a* as shown in FIG. 2. An agitating plate 7*c* is provided at one end of the supporting portion 7*b*, and an agitating spring 7*d* is provided at the other end of the supporting portion 7*b*. Further, an elastic material such as sponge is pasted on a surface portion of the toner supply roller 3. Driving force is transmitted from a toner motor through a not-shown gear to the agitating member 7 and the toner supply roller 3. Accordingly, the agitating member 7 and the toner supply roller 3 are rotated in the respective directions as shown by the arrows in the drawing. A toner supply port 9 is formed under the toner supply roller 3 in order to supply the toner in the toner hopper 2 into the development tank 1. One end of a seal member 8 is held between the toner supply port 9** and the toner supply roller 3. The seal member 8 is made of a flexible film such as polyethylene terephthalate (PET). The seal member 8 is laid over the toner supply port 9 so as to block completely. In addition, the other end of the seal member 8 is welded and secured to the rotary shaft 7*a* of the agitating member 7.

The developer cartridge is shipped and stored in the condition as set forth above. In this condition, the toner supply port 9 is blocked by the seal member 8 so that the toner hopper 2 never spills the toner into the development tank 1, and the toner supply roller 3 is never deformed along an opening of the toner supply port 9.

The seal member 8 is automatically removed when the image-forming machine is installed at a predetermined position to perform an adjustment simulation, or when supplying the toner for the first time. That is, the agitating member 7 and the toner supply roller 3 are rotated by a not-shown motor in the directions as shown by the arrows in FIG. 1. Since the one end of the seal member 8 is secured to the rotary shaft 7*a* of the agitating member 7, the seal member 8 is wound around the rotary shaft 7*a* by rotating the agitating member 7. At the time, the seal member 8 is laid with pressure under the toner supply roller 3. The toner supply roller 3 is rotated with the agitating member 7 to eject the seal member 8. Therefore, it is possible to avoid a trouble that the seal member 8 is cut off.

In the embodiment, the developer cartridge mounted in the image-forming machine body in advance has been described. However, if the developer cartridge has at least the toner hopper and the development tank (alternatively, the developer cartridge is further integrally provided with the photosensitive body, a charger unit and the like), the developer cartridge may be similarly constructed to be removably mounted with respect to the image-forming machine body. That is, the toner supply port passing from the toner hopper to the development tank is covered with the one end of the seal member, and the other end of the seal member is secured to the agitating member in the toner hopper. Then, the developer cartridge may be constructed such that the seal member can be removed when the cartridge is mounted on the image-forming machine body and the agitating member is rotated.

According to the present invention, the toner supply port provided between the toner hopper and the development tank is blocked by the seal member. The seal member is held between the toner hopper and the toner supply roller when shipping the developer cartridge. Therefore, the toner hopper never spills the toner into the development tank when shipping or storing the developer cartridge. Further, the toner supply roller is never deformed along the configuration of the toner supply port because of the blocked toner supply port, even if the cartridge is stored over a long period. Moreover, since the seal member is automatically removed by the rotation of the agitating member, it is unnecessary to perform a removing operation of the seal member when using the cartridge for the first time. In addition, it is possible to avoid an operation error of leaving the seal member when in use.

What is claimed is:

1. A developer cartridge integrally provided with a toner hopper and a development tank, having a toner supply roller disposed between said toner hopper and said development tank to supply toner from said toner hopper to said development tank, and said toner hopper including a rotatable agitating member, said developer cartridge comprising a seal member having one end held between a toner supply port and said toner supply roller to seal said toner supply port passing from said toner hopper to said development tank, and the other end secured to said agitating member, said seal member being wound around said agitating member by rotation of said agitating member.

* * * * *